US008292283B2

(12) United States Patent
Matsuno et al.

(10) Patent No.: US 8,292,283 B2
(45) Date of Patent: Oct. 23, 2012

(54) POST-PROCESSING APPARATUS AND IMAGE FORMATION SYSTEM PROVIDED WITH THE APPARATUS

(75) Inventors: Kenichi Matsuno, Yamanashi-ken (JP); Satoru Matsuki, Yamanashi-ken (JP); Komei Mohara, Yamanashi-ken (JP); Hidetoshi Kinoshita, Yamanashi-ken (JP); Yoshio Kobayashi, Yamanashi-ken (JP); Yuichi Kubota, Yamanashi-ken (JP); Koji Kurakano, Yamanashi-ken (JP); Mamoru Kubo, Yamanashi-ken (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 0 days.

(21) Appl. No.: 13/067,742

(22) Filed: Jun. 23, 2011

(65) Prior Publication Data

US 2011/0316215 A1 Dec. 29, 2011

(30) Foreign Application Priority Data

Jun. 24, 2010 (JP) ..... 2010-144104

(51) Int. Cl.
*B65H 37/04* (2006.01)
*B65H 45/20* (2006.01)

(52) U.S. Cl. ..... 270/39.01; 270/32; 270/37; 270/58.07; 493/415; 493/421

(58) Field of Classification Search ..... 270/32, 270/37, 39.01, 45, 58.07, 58.08; 493/413, 493/415, 419, 421, 430, 435, 445, 448
See application file for complete search history.

(56) References Cited

U.S. PATENT DOCUMENTS 7,975,999 B2 * 7/2011 Fukasawa et al. ..... 270/37

FOREIGN PATENT DOCUMENTS

JP 2002-308521 10/2002
JP 2008-184324 8/2008

* cited by examiner

*Primary Examiner* — Leslie A Nicholson, III
(74) *Attorney, Agent, or Firm* — Manabu Kanesaka

(57) ABSTRACT

To provide a post-processing apparatus for enabling a bunch of sheets and a single sheet to be folded in simplified structure, and further enabling the folded sheet and sheets that are not folded to be mixed and bound, the post-processing apparatus has a processing tray to collate and collect sheets to perform binding processing, and a folding processing path having a folding processing section, and a folded sheet carrying-out path for carrying out a folded sheet is provided on the downstream side of the folding processing path. Then, the folded sheet carrying-out path is comprised of a circulating path for guiding the folded sheet again to the folding processing section, a post-processing path for guiding the folded sheet to the processing tray to perform post-processing, and a sheet discharge path for guiding the folded sheet to a storage stacker.

12 Claims, 10 Drawing Sheets

IMAGE FORMATION IN STAPLE BINDING FINISH MODE

IMAGE FORMATION IN SHEET-BUNCH FOLDING FINISH MODE

POST-PROCESSING APPARATUS AND IMAGE FORMATION SYSTEM PROVIDED WITH THE APPARATUS

BACKGROUND OF THE INVENTION

1. Technical Field

The present invention relates to a post-processing apparatus for performing post-processing such as binding processing and folding processing on sheets that are carried out of an image formation apparatus such as a copier and printer, and more particularly, to improvements in the folding mechanism for folding a sheet fed from the image formation apparatus.

2. Description of the Related Art

Generally, post-processing apparatuses are widely known which perform post-processing on image-formed sheets corresponding to their use. As an aspect of the post-processing, used frequently is the processing for collating and collecting sheets and binding the sheets using a stapler. In this case, it is necessary to perform folding processing on sheets to bind.

For example, Patent Document 1 proposes a post-processing apparatus provided with a processing mechanism for guiding image-formed sheets to a processing tray to bind without performing folding processing on the sheets, and a magazine binding processing mechanism for guiding sheets to a collection section different from the processing tray, binding the center of the sheets, and then folding the sheets.

The apparatus in the Document is not provided with a mechanism for folding image-formed sheets on a sheet-by-sheet basis and performing binding processing on the sheets on the processing tray. Therefore, the Document does not propose a post-processing finish for mixing sheets which are fed to the tray without undergoing the folding processing and sheets which are fed to the tray after undergoing the folding processing and binding the sheets.

Similarly, Patent Document 2 discloses a post-processing apparatus provided with the magazine binding processing mechanism, and in the apparatus, a folding mechanism is proposed in which a mechanism for folding a bunch of collated and collected sheets in the center folds sheets on a sheet-by-sheet basis. In the Document, the mechanism is disclosed as a mechanism for storing the sheets folded on a sheet-by-sheet basis in a storage stocker in this state.

[Patent Document 1] Japanese Patent Application Publication No. 2008-184324 (FIG. 1)

[Patent Document 2] Japanese Patent Application Publication No. 2002-308521 (FIG. 2)

As described above, as the post-processing apparatus for performing binding processing on image-formed sheets, adopted conventionally is the processing method for collating and collecting the sheets to perform the binding processing without performing the folding processing, binding a bunch of collated and collected sheets and then performing the folding processing on the sheets, or performing the folding processing on the sheets on a sheet-by-sheet basis.

In addition, as a finish form, there is a case of mixing sheets without undergoing the folding processing and folding-processed sheets (for example, Z-folded sheets) in collating and collecting sheets. For example, such a form is known as a finish method for mixing a Z-folded A3-size sheet with A4-size sheets and binding the entire sheets in book form.

Then, in the conventional post-processing apparatus provided with the magazine binding mechanism for performing saddle stitching on a bunch of sheets and folding the sheets, and the end stitching mechanism for binding a bunch of sheets without performing the folding processing, to perform the above-mentioned mixing binding processing, it is necessary to provide a sheet folding unit on the upstream side of the post-processing apparatus.

Therefore, the inventor of the invention arrived at the idea of folding sheets on a sheet-by-sheet basis in the folding mechanism for folding a bunch of sheets, feeding the sheet to the processing tray, and mixing the sheet with sheets without the folding processing.

In this case, the above-mentioned Patent Document 2 discloses that a folding processing section is provided with folding rollers to perform two-folding, and folding rollers to perform three-folding, the folding processing is performed using the two-folding rollers in magazine binding, and that a single sheet is subjected to the folding processing by the two-folding rollers, and then the folding processing by the three-folding rollers. However, to prepare the rollers for two-folding and three-folding in the folding processing section, it is necessary to provide folding rolls and folding plates (folding blades) individually and include driving mechanisms therefor, and there is the problem that the apparatus becomes complicated and large.

It is an object of the invention to provide a post-processing apparatus for enabling a bunch of sheets and a single sheet to be folded in simplified structure, and further enabling the folded sheet and sheets that are not folded to be mixed and bound.

BRIEF SUMMARY OF THE INVENTION

To attain the above-mentioned object, the invention provides a processing tray to collate and collect sheets to perform binding processing, and a folding processing path having a folding processing section, and a folded sheet carrying-out path for carrying out a folded sheet is provided on the downstream side of the folding processing path. Then, it is a feature that the folded sheet carrying-out path is comprised of a circulating path for guiding the folded sheet again to the folding processing section, a post-processing path for guiding the folded sheet to the processing tray to perform post-processing, and a sheet discharge path for guiding the folded sheet to a storage stacker.

The configuration will further be described specifically. Provided are a processing tray (29) for collecting sheets that are sequentially fed, a sheet carry-in path (26) for guiding a sheet from a carry-in entrance (23) to the processing tray, a folding processing path (35) that branches off from the sheet carry-in path to perform folding processing on a sheet fed from the carry-in entrance, a folding processing section (44) disposed in the folding processing path, and a pair of folding rolls (45*a*, 45*b*) disposed in the folding processing section to perform folding processing.

Then, on the downstream side of the folding processing path is provided a folded sheet carrying-out path (P) for carrying out the folded sheet subjected to the folding processing in the folding processing section, and the folded sheet carrying-out path is comprised of circulating paths (P1, P2) for guiding the folded sheet from the folding processing section (44) to the folding processing path (35) and carrying the sheet again to the folding processing section, a post-processing path (P3) for guiding the folded sheet from the folding processing section to the processing tray (29), and a sheet discharge path (P4) for guiding the folded sheet from the folding processing section to a Storage stacker.

EFFECT OF THE INVENTION

The invention provides the folded sheet carrying-out path for carrying out the folded sheet on the downstream side of the folding processing path having the folding processing section, configures the carrying-out path using the circulating paths for guiding the folded sheet again to the folding processing section, the post-processing path for guiding the sheet to the processing tray to perform post-processing, and the sheet discharge path for guiding the folded sheet to the storage stacker, and therefore, has the effects as described below.

To the processing tray for collating and collecting sheets to perform binding processing are fed sheets without undergoing the folding processing from the sheet carry-in path and folded sheets subjected to the folding processing from the post-processing path, and therefore, it is possible to mix and bind the sheets without undergoing the folding processing and the folding-processed sheets on the processing tray.

Then, the configuration therefor enables the folded sheet from the folding processing section of the folding processing path to be fed again in the circulating path and undergo three-folding processing, and it is thus possible to configure the apparatus to be compact with simplified structure without being installed with a complicated folding processing mechanism.

Further, the invention allows a magazine binding finish by collating and collecting sheets in the folding processing path branching off from the sheet carry-in path to perform saddle stitching, and then, folding the sheets in the folding processing section, and concurrently therewith, allows an end stitching finish of folded sheets and sheets that not folded.

Then, the folding mechanism section folds a single sheet with the bunch folding roller pair, feeds the sheet again to the folding processing section with the circulating path, and thus permits Z-folding processing suitable for filing binding.

DETAILED DESCRIPTION OF PREFERRED EMBODIMENTS

Figure 1:
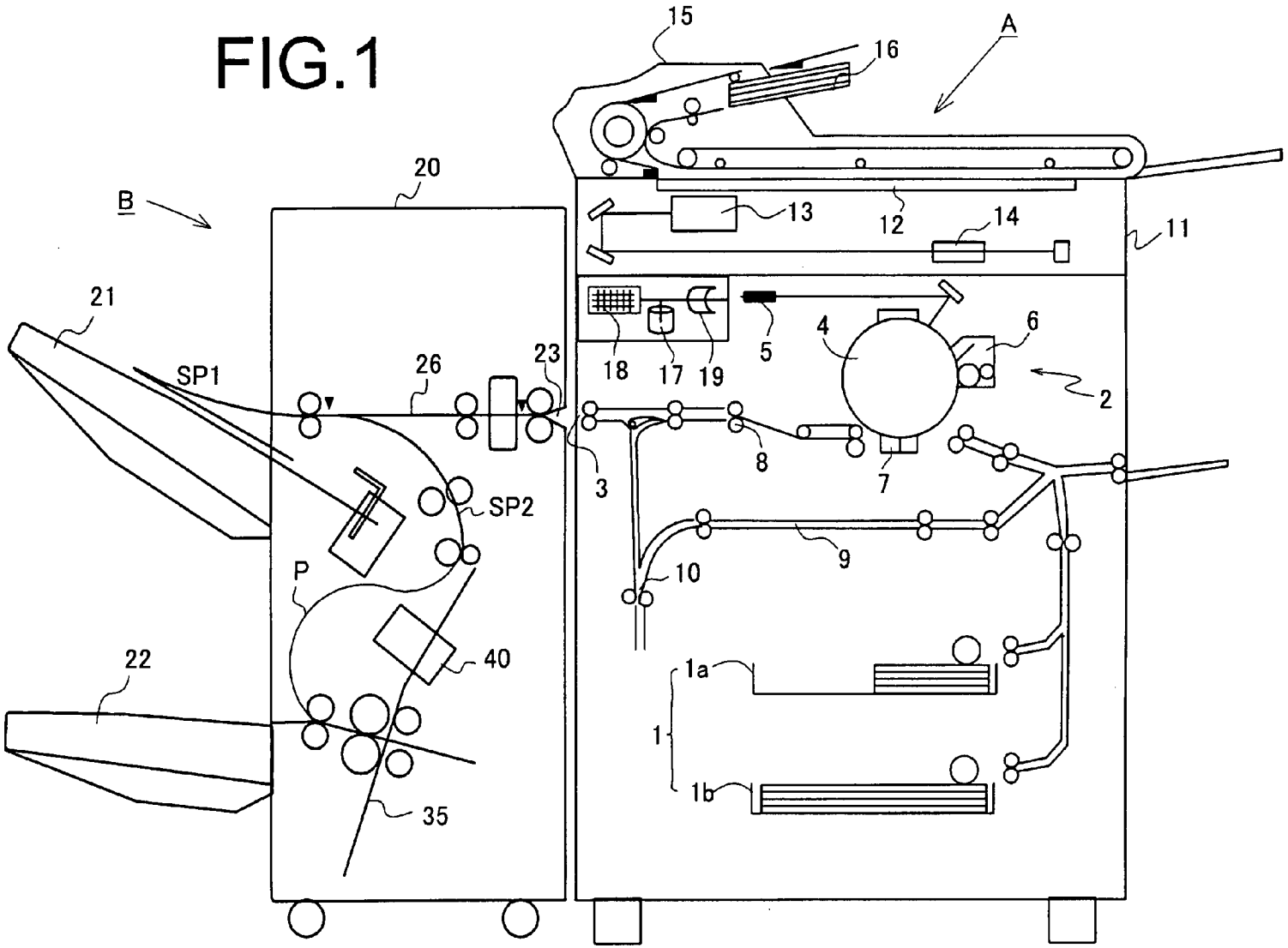
FIG. 1 is a general explanatory view of an image formation system according to the invention.
Figure 2:
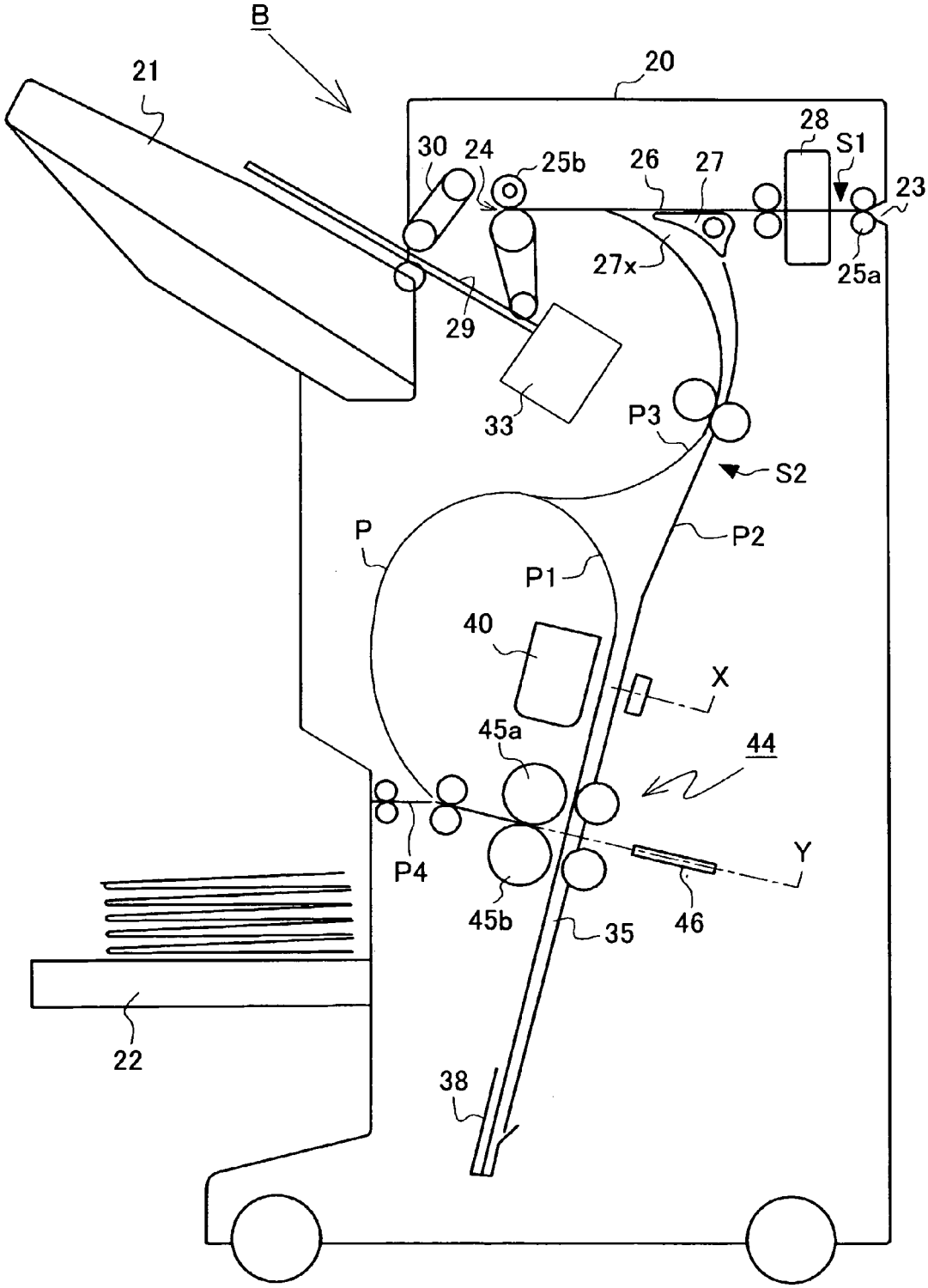
FIG. 2 is a general explanatory view of a post-processing apparatus according to the invention.
Figure 3:
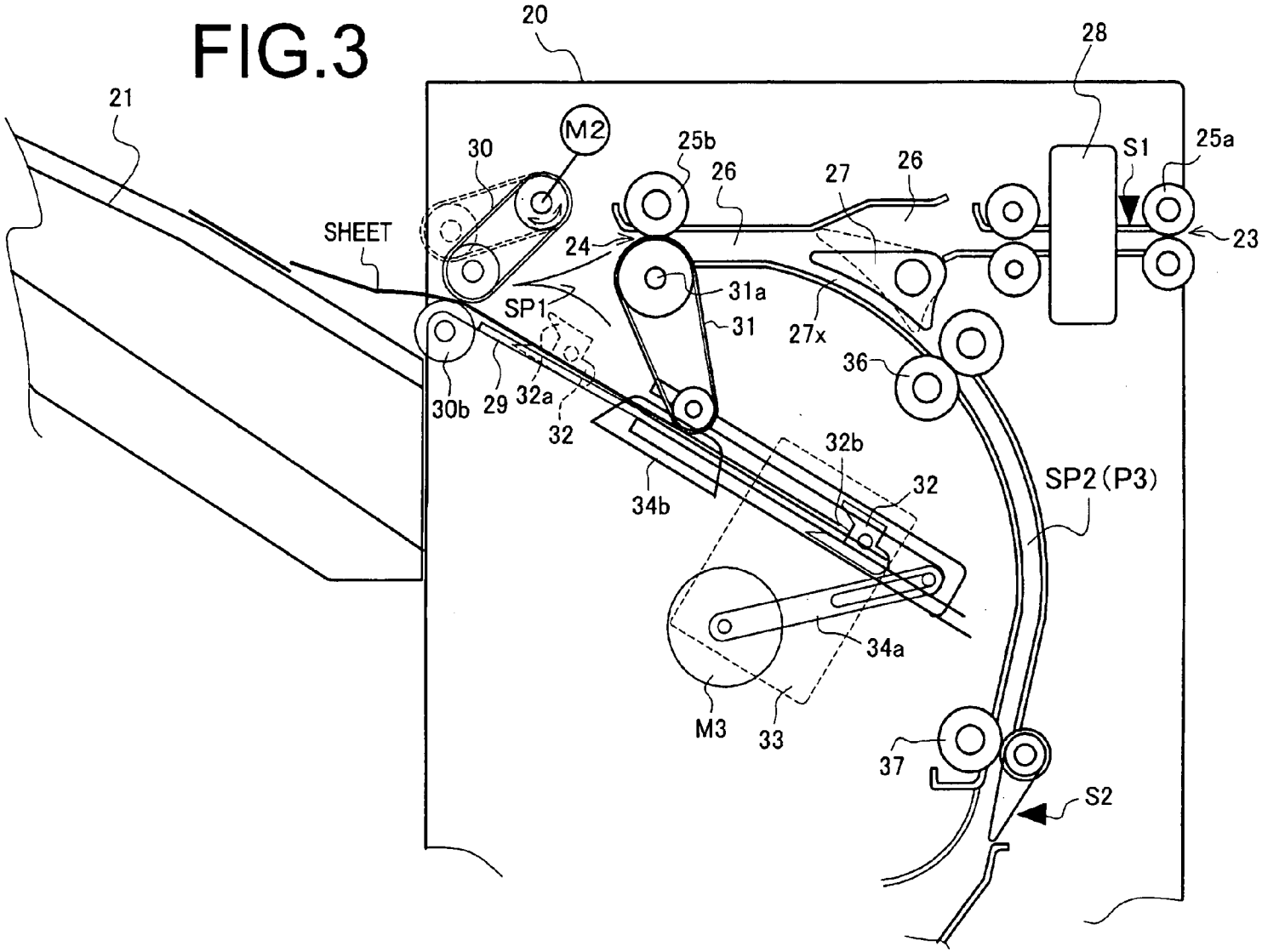
FIG. 3 is a detailed explanatory view showing part of the post-processing apparatus of FIG. 2.
Figure 4:
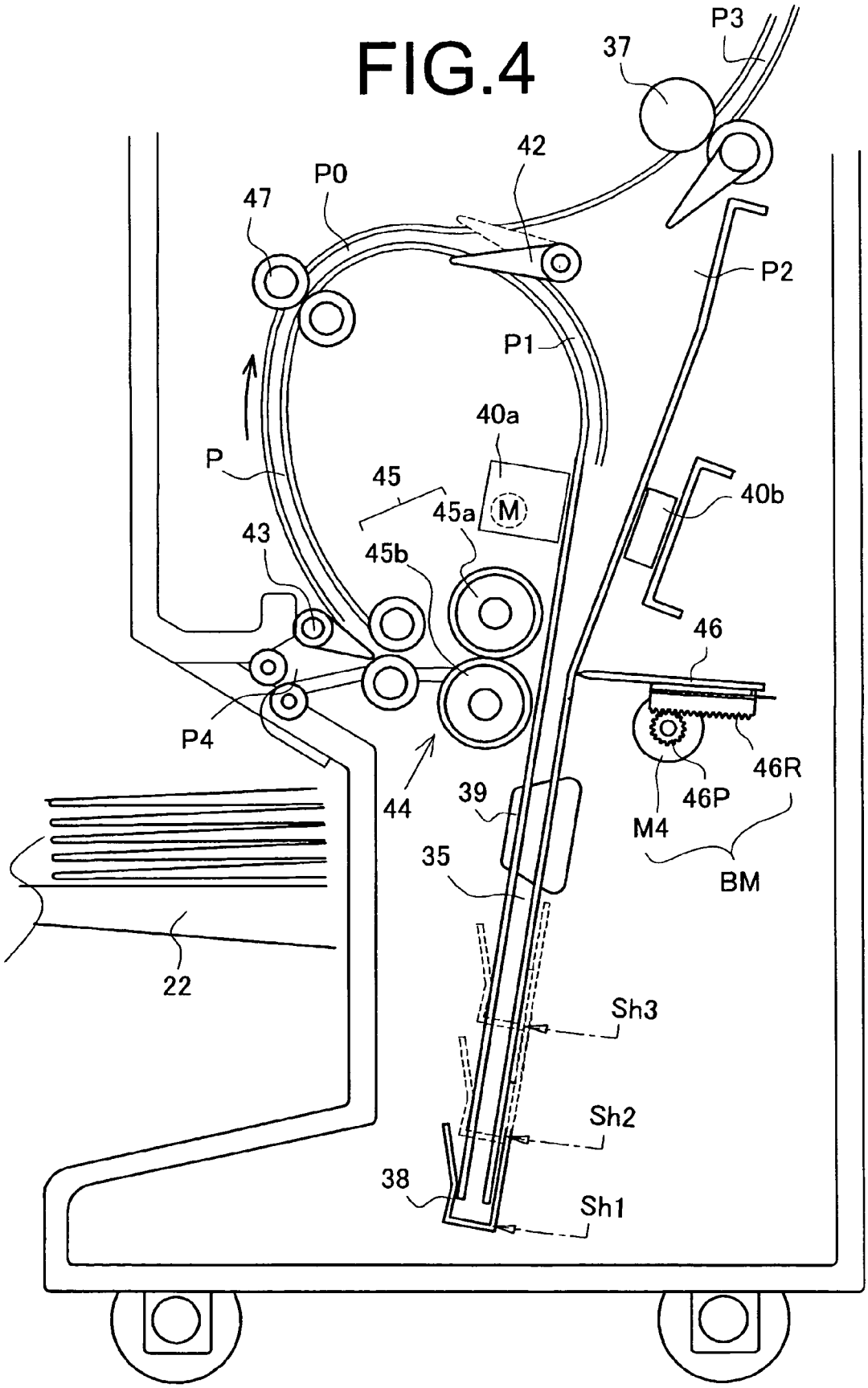
FIG. 4 is a detailed explanatory view of a folding processing section in the apparatus of FIG. 2.

The invention will specifically be described below based on preferred Embodiments shown in the figures. FIG. 1 shows the entire configuration of an image formation system according to the invention, FIG. 2 is an explanatory view of the entire configuration of a post-processing apparatus, and FIGS. 3 and 4 are explanatory views showing a detailed configuration of a sheet folding unit.

For example, a post-processing apparatus B according to the invention is coupled to a sheet discharge outlet of an image formation apparatus A as the image formation system shown in FIG. 1. The following description is given on the post-processing apparatus B and image formation apparatus A in this order.

[Configuration of the Post-Processing Apparatus]

The post-processing apparatus B according to the invention collates and collects image-formed sheets to perform bookbinding binding. The bookbinding binding is characterized by selectively performing "end stitching" for collating and collecting sheets and stapling their end edge (for example, left end edge) as shown in FIG. 6(*a*), and "magazine binding" for collating and collecting sheets, stapling their center portion, and folding the sheets as shown in FIG. 6(*b*).

Then, in the above-mentioned "end stitching", it is made possible to perform Z-folding on part of sheets and bind together as shown in FIG. 6(*a*). In addition, herein, Z-folding is a folding form for folding in a ¼ position of a sheet and then, folding in the ½ position as shown in FIG. 6(*e*), and is a folding form suitable for mixing end stitching of FIG. 6(*a*).

Therefore, the invention is characterized by enabling a folding mechanism for folding a bunch of sheets fed to a carry-in entrance for magazine binding, and a folding mechanism for folding a single sheet for mixing end stitching to be made in the single structure. The structure will be described below.

FIG. 2 shows the entire configuration of the post-processing apparatus B. An apparatus housing 20 is provided with a sheet carry-in path 26 having a carry-in entrance 23 and a carrying-out exit 24. The carry-in entrance 23 is coupled to a sheet discharge outlet 3 of the image formation apparatus A, and a processing tray 29 is provided next to the carrying-out exit 24. In the processing tray 29 is disposed end stitching stapling means 33 for performing end stitching on a collected sheet bunch.

The sheet carry-in path 26 is provided with a folding processing path 35 which branches off from the path 26 and is disposed in a position different that of the processing tray 29. The folding processing path 35 is comprised of a path guide enabling sheets to be stacked in bunch form therein.

In the apparatus of FIG. 2, the sheet carry-in path 26 is disposed in the horizontal direction, and the folding processing path 35 is disposed in the vertical direction. Then, a branch portion 27*x* of the sheet carry-in path 26 and the folding processing path 35 forms a path for reversing (switch back) the transport direction of a sheet fed from the carry-in entrance 23 to guide to the folding processing path 35, and another path for guiding the sheet without reversing the transport direction.

In the apparatus shown in the figure, the branch portion 27*x* is provided with path switching means 27 made of a flapper member. This flapper member is configured to switch between the paths by a guide attitude (first guide attitude) for guiding a sheet from the carry-in entrance 23 to the processing tray 29 and another guide attitude (second guide attitude) for guiding the sheet to the folding processing path 35 without reversing the transport direction.

Meanwhile, the processing tray 29 is provided with the end stitching stapling means 33, and the folding processing path 35 is provided with saddle stitching stapling means 40. The end stitching stapling means 33 is configured to bind a single or plurality of places in the end edge of a sheet bunch using staples. Meanwhile, the saddle stitching stapling means 40 is configured to bind a single or plurality of places in the center portion of a sheet bunch using staples.

Further, in the folding processing path 35 is disposed a folding processing section 44, and the folding processing section is provided with a folding roll pair 45*a*, 45*b*, described later, for folding a single or plurality of sheets. In addition, in FIG. 2, a folded sheet storage stacker 22 is disposed on the downstream side of the folding processing section 44, a storage stacker 21 is disposed on the downstream side of the processing tray 29, and each stacker stores a bunch of bound sheets.

In such a configuration, in the invention, on the downstream side of the folding processing path 35 is provided a folded sheet carrying-out path P for carrying out a folded sheet subjected to the folding processing in the folding processing section 44. The folded sheet carrying-out path P is comprised of circulating paths (reverse circulating path P1, non-reverse circulating path P2) for guiding the folded sheet from the folding processing section 44 to the folding processing path 35 and carrying the sheet again to the folding processing section 44, a post-processing path (P3) for guiding the folded sheet from the folding processing section 44 to the processing tray 29, and a sheet discharge path P4 for guiding the folded sheet from the folding processing section to the folded sheet storage stacker 22.

Then, the circulating paths are comprised of the reverse circulating path P1 for reversing the side of the folded sheet and carrying the sheet to the folding processing section 44, and the non-reverse circulating path P2 for carrying the sheet to the folding processing section 44 without reversing the side of the folded sheet. The reverse circulating path P1 shown in the figure is a loop path as shown in FIG. 2, and the non-reverse circulating path P2 is formed of a switchback path. This is because the reverse circulating path P1 is to provide a sheet with Z-folding or three-folding, and the non-reverse circulating path P2 provides a sheet with inward three-folding. The details will be described later.

Accordingly, the circulating paths P1 and P2 are comprised of the path for reversing the side of the folded sheet fed from the folding processing section 44 and carrying again the sheet to the folding processing section 44, and the post-processing path P3 is comprised of the path for carrying the sheet fed from the folding processing section 44 to the processing tray 29 without reversing the side of the folded sheet.

By this means, the folding processing section 44 folds in a ¼ position of the sheet fed to the carry-in entrance 23 (first folding), and the folded sheet is reversed and fed again to the folding processing section 44. Then, the sheet is folded in the ½ position (second folding) to undergo Z-folding.

The path is configured so that the Z-folded sheet is fed to the sheet carry-in path 26 without being reversed in the post-processing path P3 and is carried to the processing tray 29. Further, the sheet discharge path P4 carries the folded sheet fed from the folding processing section 44 toward the folded sheet storage stacker 22.

The details of the post-processing apparatus B will be described below according to FIGS. 3 and 4. The post-processing apparatus B is coupled to the image formation apparatus A described later, and receives image-formed sheets to perform the post-processing as described below:

(1) store sheets in the storage stacker 21 without performing post-processing on the sheets ("printout mode" described later);

(2) collate sheets in bunch form, perform end stitching on the sheets and store in the storage stocker 21 ("end stitching processing mode" described later);

(3) collate sheets in bunch form, perform saddle stitching on the sheets, then fold the sheets and store in the storage stacker 22 ("magazine binding processing mode" described later); and (4) fold sheets on a sheet-by-sheet basis and store in the folded sheet storage stacker 22 ("folding processing mode" described later).

With respect to sheets to be collated and collected on the processing tray 29, the "end stitching processing mode" enables mixing of sheets fed from the sheet carry-in path 26 without undergoing the folding processing and a Z-folding-processed sheet from the folded sheet carrying-out path P to be selected.

As shown in FIG. 3, the sheet carry-in path 26 is provided with a first switchback path SP1, and second switchback path SP2, and the path SP1 guides the sheet to the processing tray 29 on the downstream side of the path 26, while the path SP2 guides the sheet to the folding processing path 35 on the upstream side of the path 26.

In such a path configuration, in the sheet carry-in path 26 are disposed a carry-in roller 25*a* and sheet discharge 25*b*, and these rollers are coupled to a driving motor (not shown) capable of rotating forward and backward. Further, the path switching means 27 for guiding the sheet to the second switchback path SP2 is disposed in the sheet carry-in path 26, and is coupled to actuating means such a solenoid.

In addition, in between the carry-in entrance 23 and carry-in roller 25*a* is provided a post-processing unit 28 for performing post-processing such as stamping (stamping means) and punching (punching means) on a sheet from the image formation apparatus A.

[Configuration of the First Switchback Path]

The first switchback path SP1 is configured as described. As shown in FIG. 3, the sheet carry-in path 26 is provided at its exit end with the sheet discharge roller 25*b* and carrying-out exit 24, and the processing tray 29 is provided below the carrying-out exit 24 with a step height provided.

Above the processing tray 29 is disposed a forward/backward rotation roller 30 capable of moving up and down between a position for coming into contact with the sheet on the tray and a spaced waiting position (the dashed-line position in FIG. 3). The forward/backward rotation roller 30 is coupled to a forward/backward rotation motor M2, and is controlled to rotate in a clockwise direction in the figure when the sheet enters onto the processing tray 29, while rotating in a counterclockwise direction when the sheet rear end enters onto the tray.

Accordingly, the first switchback path SP1 is configured above the processing tray 29. "31" shown in the figure denotes a caterpillar belt, and is axially supported swingably so that the one-end pulley side is brought into press-contact with the sheet discharge roller 25*b*, and that the front end pulley side hangs over the processing tray 29 around the pulley shaft 31*a*. "30*b*" shown in the figure denotes a driven roller that engages in the forward/backward rotation roller 30, and is provided in the processing tray 29.

A rear end regulating member 32 for regulating the position of the sheet rear end and the end stitching stapling means 33 are disposed in the rear end portion in the sheet discharge direction of the processing tray 29. The end stitching stapling means 33 staples a single or plurality of places in the rear end edge of a bunch of sheets collected on the processing tray. Meanwhile, the rear end regulating member 32 is configured to be able to reciprocate in the sheet discharge direction along the processing tray 29 so as to act also as the conveyer function for carrying out the stapled sheet bunch to the storage stacker 21 disposed on the downstream side of the processing tray 29.

A carrying-out mechanism of the rear end regulating member 32 shown in the figure is provided with a grip hook 32*a* for grasping a bunch of sheets, and a rear end regulating surface 32*b* for striking the sheet rear end to regulate, and is configured to be movable in the lateral direction as viewed in the figure along a guide rail provided in the apparatus frame. "34*a*" shown in the figure denotes a driving arm to reciprocate the rear end regulating member 32 and is coupled to a sheet discharge motor M3.

Further, the processing tray 29 is provided with side aligning plates 34*b* for aligning the width direction of sheets collected on the tray, and the side aligning plates 34*b* are comprised of a pair of left and right (front and back in FIG. 3) aligning plates to align the sheets with reference to the center, configured to come closer and away to/from the center of the sheet, and are coupled to an alignment motor not shown. Furthermore, the processing tray 29 bridge-supports sheets (bunch) with the storage stacker 21 positioned on the downstream side, and the apparatus is thereby made compact.

[Configuration of the Second Switchback Path]

Described is a configuration of the second switchback path SP2 branching off from the sheet carry-in path 26. As shown in FIG. 3, the second switchback path SP2 changes the direction of the sheet fed in the horizontal attitude into the vertical direction, and guides the sheet to the folding processing path 35 on the downstream side.

Concurrently therewith, the second switchback path SP2 also acts as the post-processing path P3 for carrying the folded sheet subjected to the folding processing in the folding processing path 35 to the processing tray 29. Therefore, driving is conveyed to a transport roller 37 provided in the second switchback path SP2 to be able to rotate in forward and backward.

[Configuration of the Folding Processing Path]

As shown in FIG. 4, the folding processing path 35 is comprised of a guide member capable of collecting sheets in a shape with a length for accommodating the maximum size sheet therein. The path is configured in a curved or bent shape to protrude to the side on which the saddle stitching stapling means 40 and folding roll means 45 described later are disposed. This is because of ensuring the sequence of pages of sheets fed from the second switchback path SP2.

In the folding processing path 35 are disposed the saddle stitching stapling means 40, folding processing section 44, and front end regulating member 38 for regulating the sheet front end. The saddle stitching stapling means 40 is comprised of a driver unit 40*a* and anvil unit 40*b*, and performs binding processing on the center portion of a bunch of sheets collected in the folding processing path 35. The both units are supported to be movable in the width direction (paper frontside and backside direction in FIG. 4) of the sheet, and perform binding processing on a plurality of places of the bunch of sheets.

In the folding processing section 44 are disposed a pair of folding rolls 45*a*, 45*b* and the folding blade 46. The pair of folding rolls 45*a*, 45*b* are comprised of a roller pair coming into press-contact with each other, and fold sheets in bunch form or a single sheet. Further, the folding blade (folding plate) 46 inserts a fold position of the sheet (bunch) set in the folding processing path 35 into a nip portion of the folding rolls.

The front end regulating member 38 is supported by a guide rail or the like to be movable along the folding processing path 35, and is configured to shift in position among Sh1, Sh2 and Sh3 shown in the figure by shift means (not shown) corresponding to the sheet size. The front end regulating member 38 places a bunch of sheets collected in the folding processing path 35 in the position of binding processing of the saddle stitching stapling means 40, and further, places the fold position of the sheet in the folding roll pair 45*a*, 45*b*.

Accordingly, the regulation positions Sh1, Sh2, Sh3 of the front end regulating member 38 are set at optimal binding positions and folding positions corresponding to the sheet size (length in the feeding direction).

In the folding processing path 35 is disposed a sheet side edge aligning member 39 on the downstream side in the sheet transport direction. The sheet side edge aligning member 39 aligns the position in the width direction of the sheet, which is carried in the folding processing path 35 and supported by the front end regulating member 38, with the reference.

[Configuration of the Folding Roll Means]

Figure 5A:
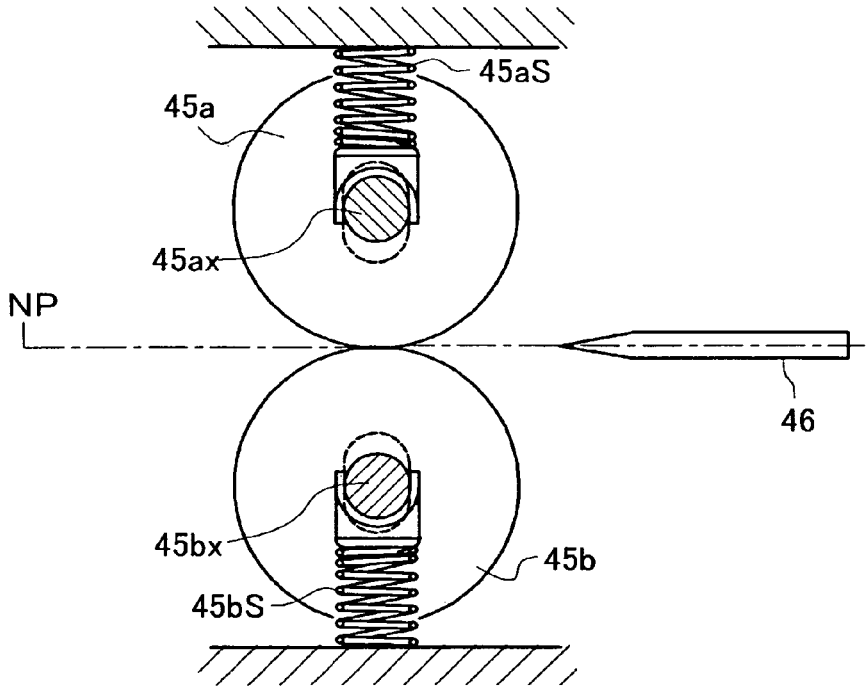
FIG. 5 contains explanatory views of folding roll means of FIG. 4, where FIG. 5(*a*) is an explanatory view of cross-sectional structure, and FIG. 5(*b*) is an explanatory view of a plane in the sheet width direction.
Figure 5B:
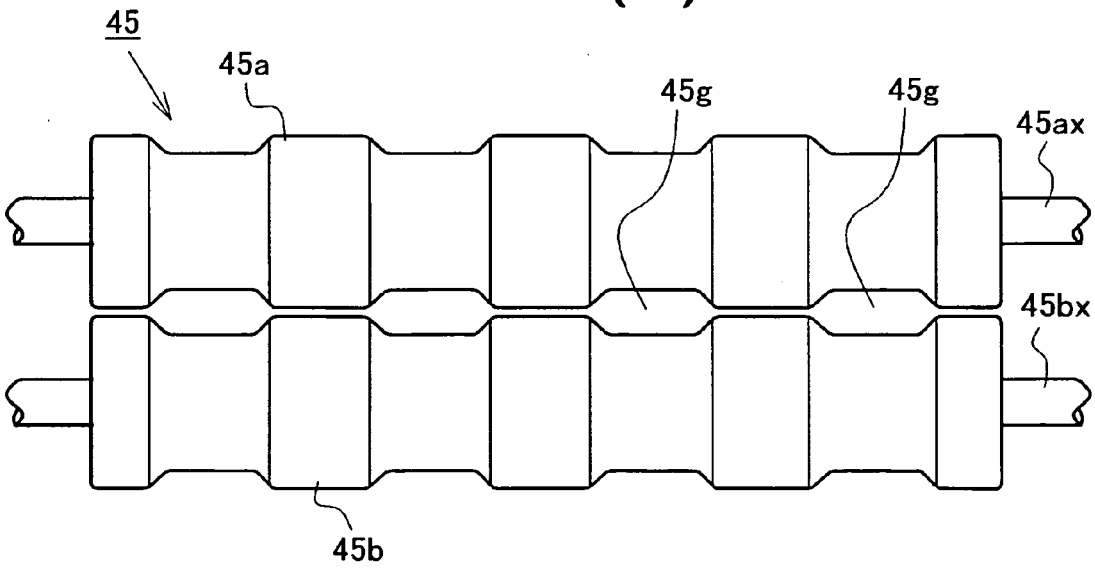
Figure 6A:
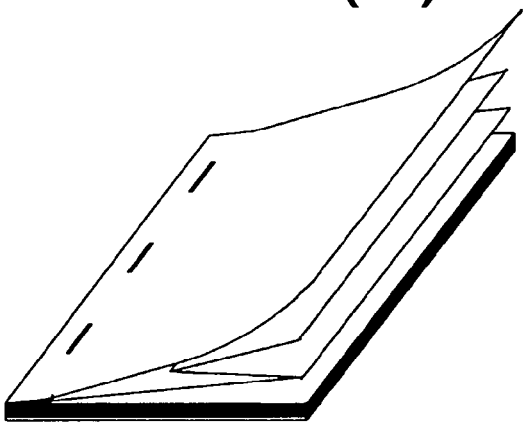
FIG. 6 is to explain a bookbinding binding method, where FIG. 6(*a*) shows mixing end stitching, FIG. 6(*b*) shows magazine binding, FIG. 6(*c*) shows inward three-folding, FIG. 6(*d*) shows Z-folding, and FIG. 6(*e*) shows ¼-Z-folding.
Figure 6B:
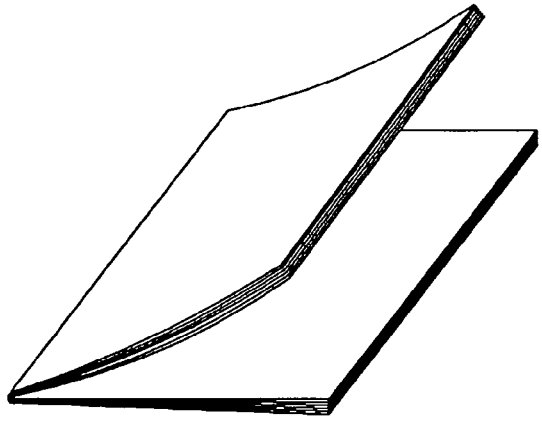
Figure 6C:
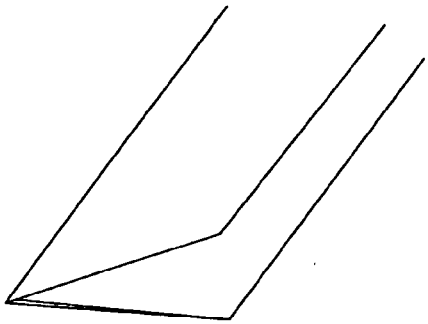
Figure 6D:
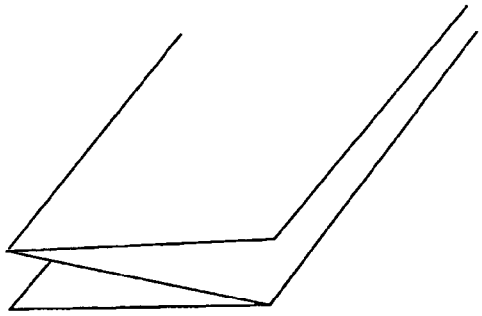
Figure 6E:
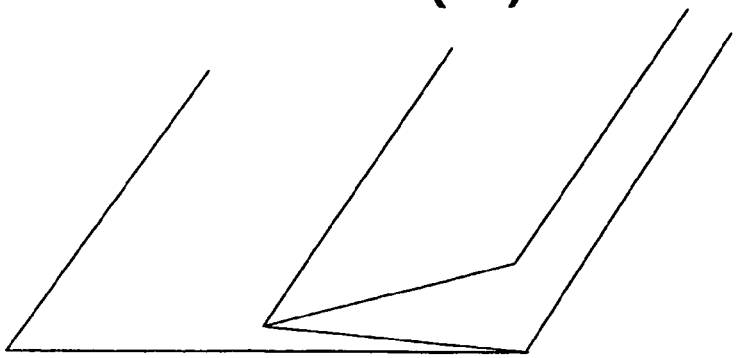

In the folding position Y disposed on the downstream side of the saddle stitching stapling means 40 are provided the folding roll means 45 for folding a bunch of sheets, and the folding blade 46 for inserting the bunch of sheets in a nip position NP (see FIG. 5(*a*)) of the folding roll means 45.

As shown in FIGS. 5(*a*) and 5(*b*), the folding roll means 45 is comprised of rolls 45*a*, 45*b* in press-contact with each other, and each roll is formed substantially in a width length of the maximum sheet. The pair of rolls 45*a*, 45*b* are fitted at their rotary shafts 45*ax*, 45*bx* with a long groove of the apparatus frame to come into press-contact with each other, and are biased in the press-contact direction by compression springs 45*a*S, 45*b*S.

In addition, it is also possible to adopt a configuration that at least one of the folding roll pair 45*a*, 45*b* is axially supported to be movable in the press-contact direction, and that a biasing spring is put on the one of rolls.

The pair of folding rolls 45*a*, 45*b* are formed of a material such as a rubber roller with a relatively high coefficient of friction. This is because of carrying a sheet in the rotation direction while bending by soft material such as rubber, and the rolls may be formed by applying lining to rubber material.

In the folding roll means 45, gaps 45*g* are formed in the sheet width direction in concavo-convex form as shown in FIG. 5(*b*). The gaps 45*g* are disposed to agree with a concavo-convex shape of the folding blade 46, described later, and it is considered that the front end of the folding blade is easy to enter in the nip between rolls. Concurrently, the gaps 45*g* are disposed in the width positions in agreement with the stapling binding positions to bind a bunch of sheets.

In other words, a pair of folding rolls 45*a*, 45*b* coming into press-contact with each other are formed in the concavo-convex shape having the gaps (gaps 45*g*) in the sheet width direction, and the blade edge of the folding blade 46, which is formed in the concavo-convex shape in accordance with the stapling binding places of the sheet, enters the gaps.

The folding blade 46 having a knife edge is provided in a position opposed to the pair of rolls 45*a*, 45*b*. The folding blade 46 is supported by the apparatus frame to be able to reciprocate between a waiting position withdrawn from the sheet and the roller nip position NP.

The folding blade 46 is coupled to a blade driving means BM. The blade driving means BM adopts a mechanism that a rack 46R integrally formed in the folding blade 46 is coupled to a pinion 46P provided in the rotary shaft of a driving motor M4, and that the folding blade 46 reciprocates in a predetermined stroke by forward and backward rotation of the driving motor M4. The folding blade 46 is provided with a position sensor, not shown, and reciprocates between the waiting position withdrawn from the folding processing path 35 and the actuation position entering inside the path.

[Transport Mechanism of the Folded Sheet Carrying-Out Path]

The folded sheet carrying-out path P is provided on the downstream side of the folding processing section 44 as described previously according to FIG. 4, and the folded sheet transport mechanism will be described.

As shown in FIG. 4, on the downstream side of the folding processing section 44 is disposed a path switching piece 43 for switching between guiding a folded sheet to the circulating paths P1, P2 and guiding the sheet to the sheet discharge path P4. On the downstream side of the path switching piece 43 is provided a common path portion P0 for guiding the folded sheet to the post-processing path P3, reverse circulating path P1 and non-reverse circulating path P2. A transport roller 47 is provided in the common path portion P0, and carries the folded sheet in the arrow direction in FIG. 4.

In a path end portion of the common path portion P0 is provided a path switching piece 42 for switching between whether or not to guide the folded sheet to the reverse circulating path P1. When the folded sheet is guided to the reverse circulating path P1 side by the path switching piece 42, the folded sheet is fed again to the folding processing section 44 with the side reversed.

Meanwhile, the transport roller 37 is provided in the path entrance of the folding processing path 35. The transport roller 37 is coupled to a driving motor (not shown) to be able to rotate forward and backward. In the state of FIG. 4, the roller rotates in a counterclockwise direction in carrying the sheet in the folding processing path 35, while rotating in a clockwise direction in carrying out the folded sheet of the common path portion P0.

In the entrance of the folding processing path 35 is disposed a sensor S2 for detecting the sheet front end. Then, the folded sheet fed from the common path portion P0 is switched back by rotating the transport roller 37 in the path entrance forward and backward, and the non-reverse circulating path P2 is configured to feed the sheet again to the folding processing section 44 with the side not reversed.

Meanwhile, the folded sheet fed from the common path portion P0 is guided to the second switchback path SP2 as shown in FIG. 3, and guided from the path to the processing tray 29. Accordingly, this second switchback path SP2 constitutes the post-processing path P3.

In addition, in this case, it is also possible to configure the post-processing path P3 such that the path P3 is a path different from the second switchback path SP2 and guides the folded sheet to the processing tray 29.

In the second switchback path SP2 (post-processing path P3) is disposed a transport roller 36, and this roller pair is also coupled to the driving motor to be able to rotate forward and backward. Then, the path switching means 27 disposed in the branch portion 27*x* described previously is coupled to a driving means, not shown, so as to guide a sheet fed from the carry-in entrance 23 toward the processing tray 29 in the solid-line state in FIG. 3, and change the position to the dashed-line position in the figure in a stage in which the sheet rear end is passed through the branch portion 27*x*.

Accordingly, the path switching means 27 is capable of guiding the carried-in sheet to the sheet carry-in path 26 in the solid-line state as shown in the figure, while guiding the sheet to the folding processing path 35 in the dashed-line state, and in this state, being capable of guiding the folded sheet subjected to the folding processing to the processing tray 29.

[Explanation of the Post-Processing Operation]

The above-mentioned post-processing apparatus is provided with a "printout mode", "end stitching processing mode", "magazine binding processing mode" and "folding processing mode".

The post-processing operation in each mode will be described. In addition, the apparatus as shown in the figure shows the case where an image-formed sheet is carried out of the image formation apparatus A, described later, face down.

Accordingly, when a sheet is carried out of the image formation apparatus A face up, the invention is capable of being carried into practice by modifying the post-processing as appropriate.

Figure 9A:
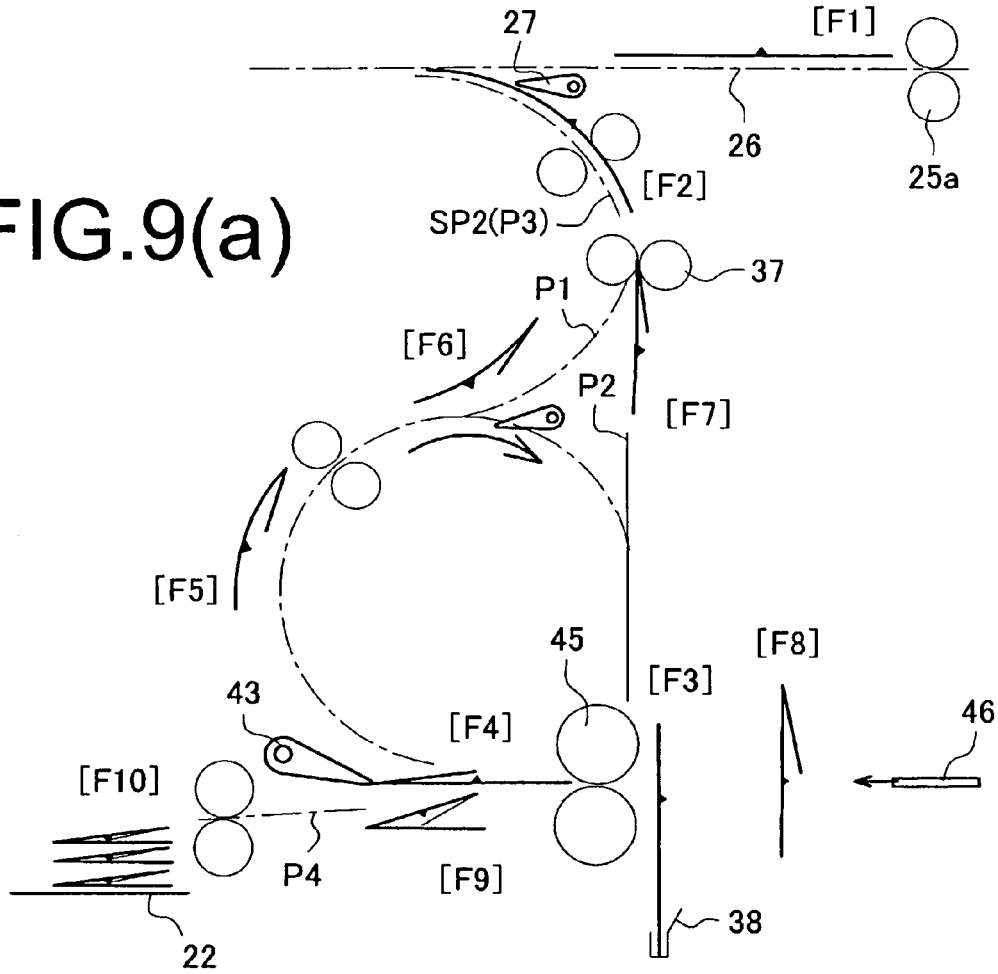
FIG. 9 contains explanatory views of post-processing operation, where FIG. 9(*a*) shows a folding processing mode (inward three-folding), and FIG. 9(*b*) shows a printout mode.
Figure 9B:
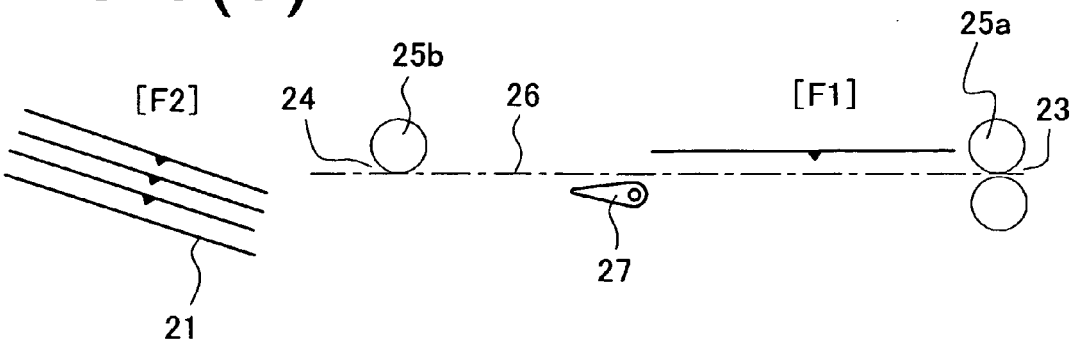

In the "printout mode", as shown in FIG. 9(*b*), a sheet fed to the carry-in entrance 23 is fed from the sheet carry-in path 26 to the carrying-out exit 24, passed on the processing tray 29, and stored in the storage stacker 21 on the downstream side.

Accordingly, the sheet is loaded and stored in the storage stacker 21 from the carry-in entrance 23 without undergoing the folding processing or post-processing.

In the "end stitching processing mode", sheets fed to the carry-in entrance 23 are fed from the sheet carry-in path 26 to the carrying-out exit 24, collated and collected on the processing tray 29, and stapled. At this point, in performing the folding processing on all the sheets, or in performing the folding processing on part of the sheets, the sheets undergo transport processing as described below.

Figure 8A:
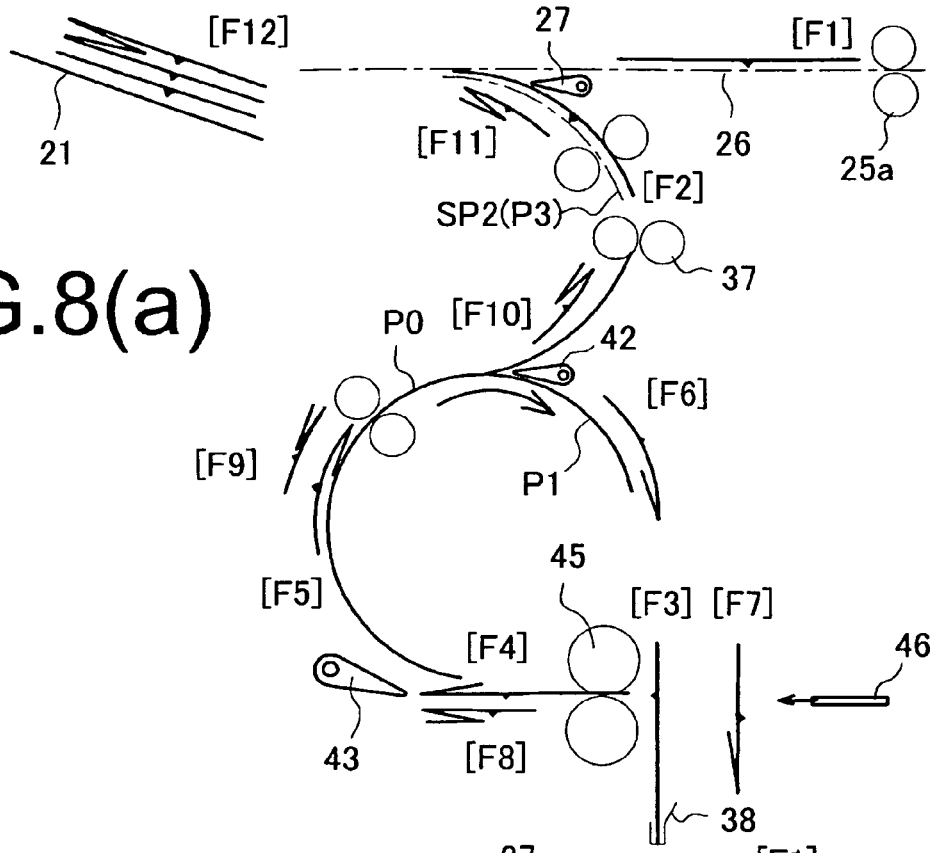
FIG. 8 contains explanatory views of post-processing operation, where FIG. 8(*a*) shows a bridge binding processing mode, and FIG. 8(*b*) shows a folding processing mode (outward three-folding)
Figure 8B:
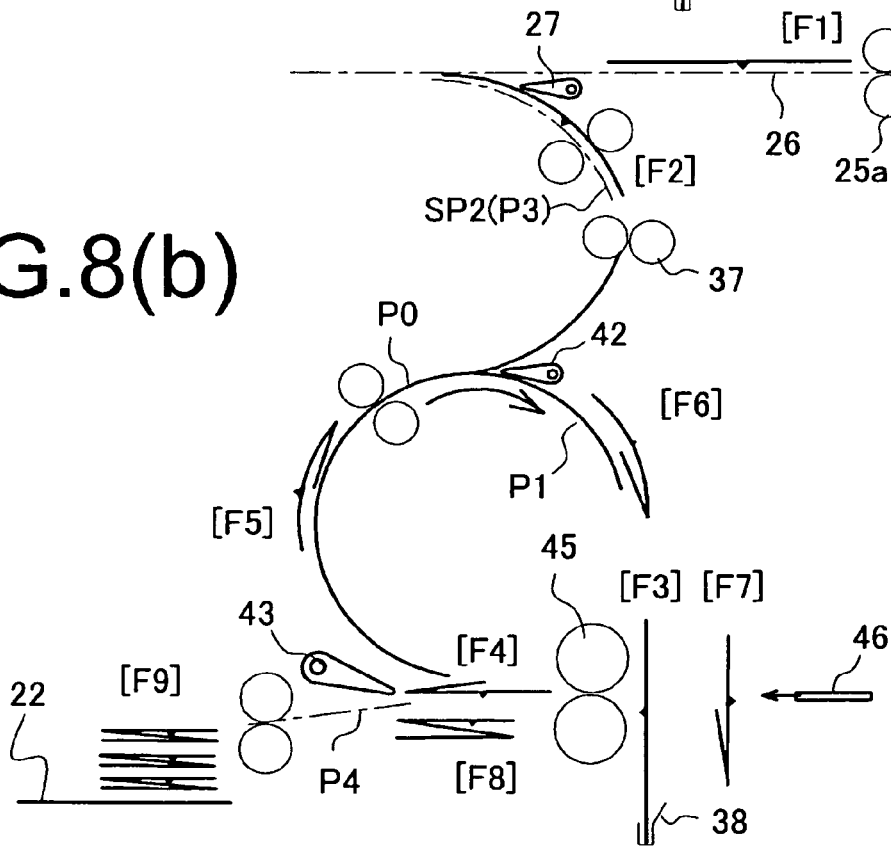

As shown in FIG. 8(*a*), the image-formed sheet is fed to the sheet carry-in path 26 in the state of [F1] in FIG. 8(*a*). This sheet is fed to the processing tray side, and fed from the second switchback path SP2 to the folding processing path 35 ([F2], [F3] in FIG. 8(*a*)). At this point, the front end regulating member 38 regulates the sheet front end to position a ¼ position on the rear end side of the sheet in the folding processing section 44, and the sheet is folded with the folding roll means 45 and folding blade 46.

The folded sheet is carried out of the folding roll means 45 in the state of [F4] in FIG. 8(*a*), reversed in the reverse circulating path P1, and fed to the folding processing section ([F5], [F6], [F7] in FIG. 8(*a*)). For example, this sheet is second folded in a ½ position of the sheet with the folding roll means 45 and folding blade 46.

Then, the folded sheet is fed from the folding roll pair 45*a*, 45*b* in the state of [F8] in FIG. 8(*a*), fed to the common path portion P0, and further fed to the post-processing path P3 ([F9], [F10], [F11] in FIG. 8(*a*)). Then, the sheet is fed to the processing tray 29 via the sheet carry-in path 26. In addition, in this case, each of the path switching piece 42 (43), path switching means 27, transport roller 37 and transport roller 36 is controlled corresponding to the transport direction of the sheet.

The folded sheet thus loaded and stored on the processing tray 29 is collated and collected while being mixed with sheets transported from the sheet carry-in path 26 without undergoing the folding processing. Then, as described later, the sheets are stapled, and after the stapling processing, the bunch is carried out to the storage stacker 21 ([F12] in FIG. 8(*a*)).

In the "folding processing mode", FIG. 8(*b*) shows outward three-folding, and FIG. 9(*a*) shows inward three-folding. In outward three-folding, as in Z-folding described previously, the sheet is fed from the sheet carry-in path 26 to the folding processing path 35 through the second switchback path SP2 ([F1], [F2], [F3] in FIG. 8(*b*)).

At this point, the front end regulating member 38 regulates the sheet front end to position a ⅓ position on the rear end side of the sheet in the folding processing section 44, and the sheet is folded with the folding roll means 45 and folding blade 46. The folded sheet is carried out of the folding roll pair 45*a*, 45*b* in the state of [F4] in FIG. 8(*b*), reversed in the reverse circulating path P1, and fed to the folding processing section 44 ([F5], [F6], [F7] in FIG. 8(*b*)). This sheet is second folded in a ⅓ position of the sheet with the folding roll means 45 and folding blade 46. Then, the folded sheet is fed from the folding roll pair 45*a*, 45*b* in the state of [F8] in FIG. 8(*b*), and is stored in the folded sheet storage stacker 22 from the sheet discharge path P4 ([F9] in FIG. 8(*b*)).

Meanwhile, in inward three-folding, as shown in FIG. 9(*a*), the image formation apparatus A forms an image on a sheet face up. As in outward three-folding described previously, the sheet is fed from the sheet carry-in path 26 to the folding processing path 35 through the second switchback path SP2 ([F1], [F2], [F3] in FIG. 9(*a*)). Then, the sheet is folded in a ⅓ position on the rear end side of the sheet in the folding processing section 44.

The folded sheet is carried out of the folding roll pair 45*a*, 45*b* in the state of [F4] in FIG. 9(*a*), and fed again to the folding processing section 44 by the non-reverse circulating path P2 without being reversed ([F5], [F6], [F7], [F8] in FIG. 9(*a*)).

Next, this sheet is second folded in a ⅓ position of the sheet with the folding roll means 45 and folding blade 46. Then, the folded sheet is fed from the folding roll pair 45*a*, 45*b* in the state of [F9] in FIG. 9(*a*), and is stored in the folded sheet storage stacker 22 from the sheet discharge path P4 ([F10] in FIG. 9(*a*)).

In addition, the "magazine binding processing mode" will be described later.

[Configuration of the Image Formation Apparatus]

In the image formation apparatus A shown in FIG. 1, a paper feed section 1 feeds a sheet to an image formation section 2, the image formation section 2 prints in the sheet, and the sheet is carried out of a main-body sheet discharge outlet 3. The paper feed section 1 stores sheets of a plurality of sizes in paper cassettes 1*a*, 1*b*, and separates designated sheets on a sheet-by-sheet basis to feed to the image formation section 2.

In the image formation section 2, for example, an electrostatic drum 4, and a printing head (laser emitting device) 5, developing device 6, transfer charger 7 and fuser 8 arranged around the drum 4 are disposed, the laser emitting device 5 forms an electrostatic latent image on the electrostatic drum 4, the developing device 6 adds toner to the image, the transfer charger 7 transfers the image onto the sheet, and the fuser 8 heats and fuses the image.

The sheet with the image thus formed is sequentially carried out of the main-body sheet discharge outlet 3. "9" shown in the figure denotes a circulating path, and is a path for two-side printing for reversing the side of the sheet printed on the front side from the fuser 8 via a main-body switchback path 10, then feeding the sheet again to the image formation section 2; and printing on the back side of the sheet. Thus two-side printed sheet is carried out of the main-body sheet discharge outlet 3 after the side of the sheet is reversed by the main-body switchback path 10.

"11" shown in the figure denotes an image reading apparatus, scans an original document sheet set on a platen 12 with a scan unit 13, and electrically reads the sheet with a photoelectric conversion element not shown. For example, the image data is subjected to digital processing in an image processing section, and then, transferred to a data storing section 14, and an image signal is sent to the laser emitting device 5. Further, "15" shown in the figure denotes an original document feeding apparatus that is a feeder apparatus which feeds original document sheets stored in a stacker 16 to the platen 12.

Figure 10:
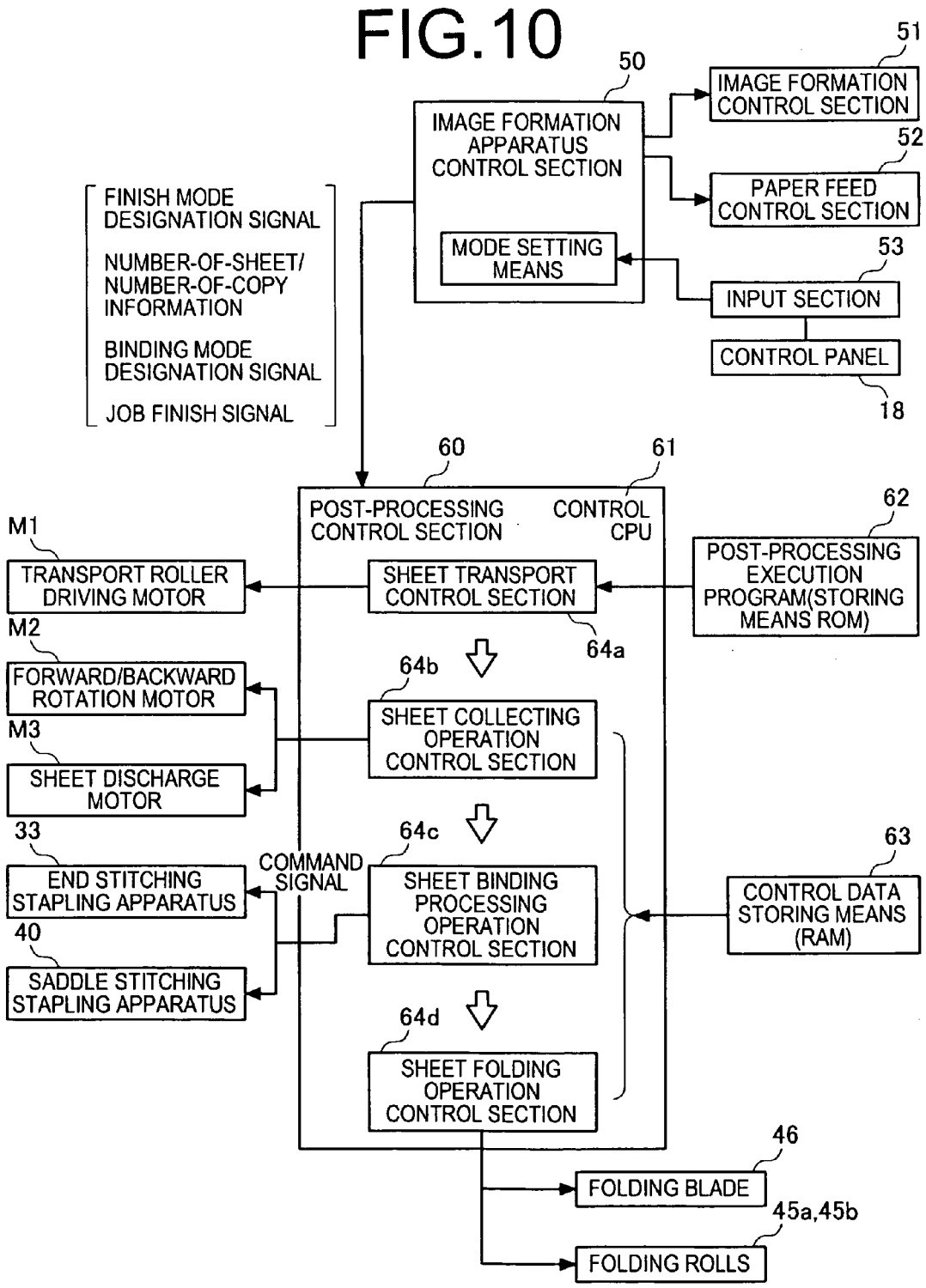
FIG. 10 is an explanatory view of a control configuration in the system of FIG. 1.

The image formation apparatus A with the above-mentioned configuration is provided with a control section (controller) 50 as shown in FIG. 10, and image formation conditions such as, for example, sheet size designation and color/monochrome printing designation and printout conditions such as number-of-copy designation, one-side/two-side printing designation, and scaling printing designation are set from a control panel 18.

Meanwhile, the image formation apparatus A is configured so that image data read by the scan unit 13 or image data transferred from an external network is stored in the data storing section 17, the data storing section 17 transfers the image data to buffer memory 19, and that the buffer memory 19 transfers a data signal to the printing head 5 sequentially.

Concurrently with the image formation conditions, a post-processing condition is also input and designated from the control panel 18. As the post-processing condition, for example, selected is a "printout mode", "staple binding mode", "sheet-bunch folding mode" or the like.

Then, the image formation apparatus A forms images on sheets corresponding to the image formation condition and the post-processing condition. When "one-side printing" is set as the image formation condition and the "printout mode" or "staple binding mode" is set as the post-processing condition, the image formation section 2 forms a predetermined image on a designated sheet, and the sheet is reversed in the main-body switchback path 10 and then, carried out to the main-body sheet discharge outlet 3.

An aspect of the image formation will be described based on FIG. 7. The image formation apparatus A forms images sequentially on a series of sheets from the first page to nth page. The post-processing apparatus B described later receives the sheets that are carried out face down from the first page, and sequentially loads and stores the sheets in the storage stacker 21 disposed in the post-processing apparatus B in the "printout mode", while collating and collecting the sheets on the processing tray 29 described previously disposed in the post-processing apparatus B in the "end stitching processing mode". The sheets collected on the processing tray are stapled in the end stitching stapling means 33 using a job finish signal, and stored in the storage stacker 21.

Figure 7:
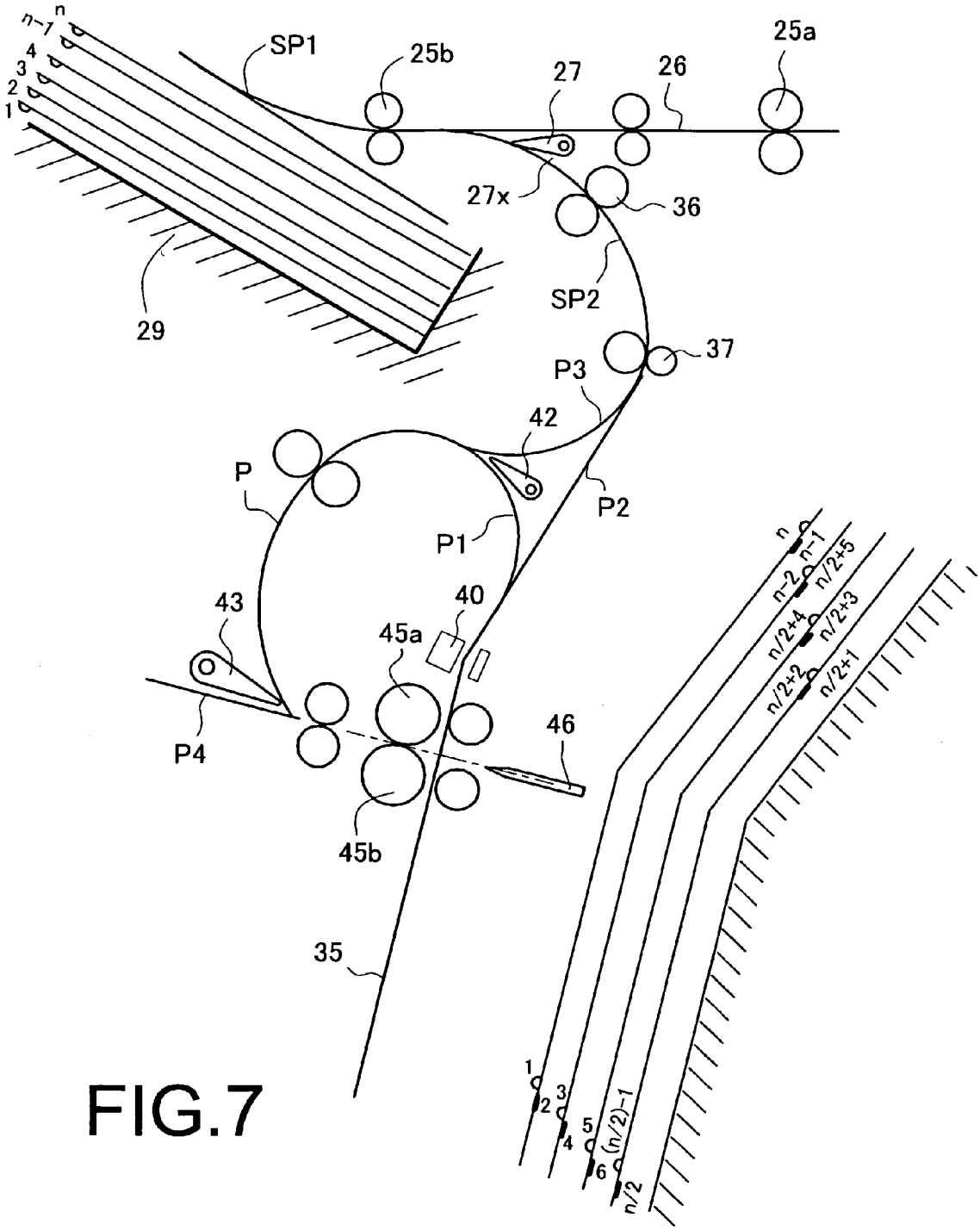
FIG. 7 is an explanatory view showing the order of image formation in the apparatus of FIG. 1.

Meanwhile, when two-side printing and 2 in 1 printing is designated in the image formation condition and the "sheet-bunch folding mode" is set as the post-processing, as shown in FIG. 7, in the case where the last page is page n, the image formation apparatus A forms an image of the (n/2)th page and an image of the (n/2+1)th page on the frontside of the first sheet and an image of the (n/2−1)th page and an image of the (n/2+2)th page on the backside thereof, and carries out the sheet from the main-body sheet discharge outlet 3. Then, the post-processing apparatus B described later stores the sheet in the folding processing path 35 from the sheet carry-in path 26.

Next, the image formation apparatus A forms an image of the (n/2−2)th page and an image of the (n/2+3)th page on the frontside of the next sheet and an image of the (n/2−3)th page and an image of the (n/2+4) th page on the backside thereof, and carries out the sheet from the main-body sheet discharge outlet 3.

Then, the post-processing apparatus B stacks the sheet on the previous sheet to collect. Thus, the image formation apparatus A forms images in the order adapted to the processing tray structure of the post-processing apparatus B. For such an order of pages, the printing order is calculated when the data storing section 17 transfers the image data to the buffer memory 19, and the printing head (laser emitting device) 5 is controlled.

[Explanation of a Control Configuration]

A control configuration of the above-mentioned image formation system will be described according to the block diagram of FIG. 10. The image formation system as shown in FIG. 1 is provided with a control section (hereafter, referred to as a "main-body control section") 50 of the image formation apparatus A and a control section (hereinafter, referred to as a "post-processing control section") 60 of the post-processing apparatus B.

The main-body control section 50 is provided with an image formation control section 51, paper feed control section 52, and input section 53. Then, the "image formation mode" and the "post-processing mode" are set from the control panel 18 provided in the input section 53. As the image formation mode, as described previously, the number of copies, sheet size, color/monochrome printing, scaling printing, one-side/two-side printing, and other image formation conditions are set.

Then, corresponding to the set image formation conditions, the main-body control section 50 controls the image formation control section 51 and the paper feed control section 52, forms images on predetermined sheets, and sequentially carries out the sheets from the main-body sheet discharge outlet 3.

Concurrently with the image formation conditions, the post-processing mode is set by input from the control panel 18. For example, the post-processing mode is set at the "print-out mode", "staple binding finish mode", "sheet-bunch folding finish mode" or the like.

Then, the main-body control section 50 transfers the post-processing finish mode, number-of-sheet/number-of-copy information, and binding mode (stapling of a single place, or stapling of two or more places) information to the post-processing control section 60. Concurrently therewith, the main-body control section 50 transfers a job finish signal to the post-processing control section 60 whenever image formation is finished.

The post-processing control section 60 is provided with a control CPU 61 to operate the post-processing apparatus B corresponding to the designated finish mode, ROM 62 that stores operating programs, and RAM 63 that stores control data. Then, the control CPU 61 is provided with a sheet transport control section 64*a* that executes transport of sheets fed to the carry-in entrance 23, a sheet collecting operation control section 64*b* that executes the sheet collecting operation, a sheet binding operation control section 64*c* that executes the sheet binding operation, and a sheet folding operation control section (driving control means) 64*d* that executes the sheet bunch folding operation.

The sheet transport control section 64*a* is coupled to a control circuit of the driving motor M1 of the carry-in roller 25*a* and sheet discharge roller 25*b* in the sheet carry-in path 26 described previously, and is configured to receive detection signals from the sheet sensor S1 disposed in the path 26.

Further, the sheet collecting operation control section 64*b* is connected to driving circuits of the forward/backward rotation motor M2 of the forward/backward rotation roller 30, and the sheet discharge motor M3 of the rear end regulating member 32 so as to collect sheets on the processing tray 29.

Furthermore, the sheet binding operation control section 64*c* is connected to driving circuits of driving motors incorporated into the end stitching stapling means 33 of the processing tray 29 and the saddle stitching stapling means 40 of the folding processing path 35.

[Magazine Binding Processing Operation]

The operation of the magazine binding processing will be described in the above-mentioned control configuration. In this mode, the image formation apparatus A forms images on sheets, for example, in the order described according to FIG. 7, and the post-processing apparatus B finishes the sheets in book form.

Therefore, the post-processing apparatus B shifts the path switching means 27 of the sheet carry-in path 26 to the solid-line state of FIG. 3. By this means, the sheet fed to the sheet carry-in path 26 is guided to the sheet discharge roller 25*b*. Then, the control CPU 61 halts the sheet discharge roller 25*b* at timing at which the sheet rear end passes through the path switching means 27 with reference to a signal such that the sheet sensor S1 detects the sheet rear end, and concurrently shifts the path switching means 27 to the dashed-line position in FIG. 3.

Then, the CPU 61 rotates the sheet discharge roller 25*b* backward (the counterclockwise direction in FIG. 3). In this way, the sheet entering the sheet carry-in path 26 is reversed in the transport direction, and guided to the second switchback path SP2 from the path switching means 27. Then, the sheet is guided to the folding processing path 35 by the transport rollers 36, 37 disposed in the path SP2.

At timing at which the sheet is carried in the folding processing path 35 from the second switchback path SP2, the control CPU 61 shifts the front end regulating member 38 to the Sh1 position that is the lowest end. Then, the whole of the sheet is supported by the folding processing path 35. In this state, a subsequent sheet is fed from the second switchback path SP2 onto the folding processing path 35, and the subsequent sheet is stacked on the prior sheet. Then, in accordance with carry-in of the subsequent sheet, the CPU 61 shifts the front end regulating member 38 from the Sh3 position to the Sh1 position.

Next, as in the previous manner, the CPU 61 operates the sheet side edge aligning member 39, and aligns the width of the sheet that is carried in and the sheet that is supported on the folding processing path 35. By repeating such operation, the sheets with the images formed in the image formation apparatus A are collated on the folding processing path 35 through the second switchback path SP2.

Then, upon receiving a job finish signal, the control CPU 61 shifts the front end regulating member 38 to the position Sh2, and sets and positions the center of the sheets in the binding position X.

Therefore, the control CPU 61 operates the saddle stitching stapling means 40, and staples a single or plurality of places in the center of sheets. By a completion signal of the operation, the control CPU 61 shifts the front end regulating means 38 to the position Sh1, and sets and positions the center of the sheets in the folding position Y. Then, the center portion of the bunch of sheets is folded with the folding roll pair 45*a*, 45*b* and folding blade 46 described previously.

In addition, in the invention, the case is shown where the saddle stitching stapling means 40 is disposed in the binding position X on the folding processing path 35 described previously, and it is also possible to adopt a configuration that the collection guide, binding position and folding position are arranged in this order in the sheet processing path, in which arranged are the collection guide means, next a stapling apparatus, and sheet folding means on the downstream side thereof.

Further, it is also possible to fold a bunch of sheets to carry out to the folded sheet storage stacker 22 without performing the binding processing in the saddle stitching stapling means 40.

In addition, this application claims priority from Japanese Patent Application No. 2010-144104 incorporated herein by reference.

The invention claimed is:

1. A post-processing apparatus comprising:

a processing tray for collecting a sheet that is sequentially fed to perform binding processing;

a sheet carry-in path for guiding the sheet from a carry-in entrance to the processing tray;

a folding processing path that branches off from the sheet carry-in path to perform folding processing on a sheet fed from the carry-in entrance;

a folding processing section disposed in the folding processing path; and a pair of folding rolls disposed in the folding processing section to perform folding processing, wherein on the downstream side of the folding processing path is provided a folded sheet carrying-out path for carrying out a folded sheet subjected to the folding processing in the folding processing section, and the folded sheet carrying-out path is comprised of a circulating path for guiding the folded sheet from the folding processing section to the folding processing path and carrying the sheet again to the folding processing section, a post-processing path for guiding the folded sheet from the folding processing section to the processing tray, and a sheet discharge path for guiding the folded sheet from the folding processing section to a storage stacker.

2. The post-processing apparatus according to claim 1, wherein the circulating path is comprised of a path for reversing the side of the folded sheet fed from the folding processing section and carrying the sheet again to the folding processing section, and the post-processing path is comprised of a path for carrying the folded sheet fed from the folding processing section to the processing tray without reversing the side of the folded sheet.

3. An image formation system comprising:

an image formation apparatus that sequentially forms images on sheets; and a post-processing apparatus that collates and collects the sheets fed from the image formation apparatus to bind, wherein the post-processing apparatus has a configuration as described in claim 2.

4. The post-processing apparatus according to claim 1, wherein the circulating path is comprised of a reverse circulating path for reversing the side of the folded sheet fed from the folding processing section and carrying the sheet again to the folding processing section, and a non-reverse circulating path for carrying the folded sheet again to the folding processing path without reversing the side of the folded sheet.

5. An image formation system comprising:

an image formation apparatus that sequentially forms images on sheets; and a post-processing apparatus that collates and collects the sheets fed from the image formation apparatus to bind, wherein the post-processing apparatus has a configuration as described in claim 4.

6. The post-processing apparatus according to claim 1, wherein the processing tray is provided with end stitching stapling means for collating and collecting sheets fed from the sheet carry-in path to bind, and the folding processing path is provided with saddle stitching binding means for collating and collecting sheets fed from the carry-in entrance to bind.

7. The post-processing apparatus according to claim 6, further comprising:

control means, wherein the control means has a saddle stitching processing mode and an end stitching processing mode, the saddle stitching processing mode is configured to execute operation for reversing a transport direction of sheets fed from the carry-in entrance, collating and collecting the sheets in the folding processing path, and then binding the sheets, operation for folding a bunch of the bound sheets in the folding processing section, and operation for storing the bunch of the sheets subjected to the folding processing in the storage stocker from the sheet discharge path, and the end stitching processing mode is configured to execute operation for carrying sheets fed from the carry-in entrance to the folding processing path to perform the folding processing, and carrying the folded sheets from the post-processing path to the processing tray, and operation for collating and collecting the folded sheets subjected to the folding processing on the processing tray to bind.

8. The post-processing apparatus according to claim 7, wherein the end stitching processing mode by the control means has operation for mixing and loading the sheet fed from the sheet carry-in entrance without performing the folding processing and the folded sheet fed from the folded sheet carrying-out path on the processing tray, in collating and collecting sheets on the processing tray.

9. An image formation system comprising:

an image formation apparatus that sequentially forms images on sheets; and a post-processing apparatus that collates and collects the sheets fed from the image formation apparatus to bind, wherein the post-processing apparatus has a configuration as described in claim 6.

10. An image formation system comprising:

an image formation apparatus that sequentially forms images on sheets; and a post-processing apparatus that collates and collects the sheets fed from the image formation apparatus to bind, wherein the post-processing apparatus has a configuration as described in claim 7.

11. An image formation system comprising:

an image formation apparatus that sequentially forms images on sheets; and a post-processing apparatus that collates and collects the sheets fed from the image formation apparatus to bind, wherein the post-processing apparatus has a configuration as described in claim 8.

12. An image formation system comprising:

an image formation apparatus that sequentially forms images on sheets; and a post-processing apparatus that collates and collects the sheets fed from the image formation apparatus to bind, wherein the post-processing apparatus has a configuration as described in claim 1.

* * * * *